US005092794A

United States Patent [19]

Kachlic

[11] Patent Number: 5,092,794

[45] Date of Patent: Mar. 3, 1992

[54] SHIELDED ELECTRICAL CONNECTOR

[75] Inventor: Jerry D. Kachlic, Singapore, Singapore

[73] Assignee: Molex Incorporated, Lisle, Ill.

[21] Appl. No.: 632,725

[22] Filed: Dec. 24, 1990

[51] Int. Cl.[5] ..... H01R 13/648

[52] U.S. Cl. ..... 439/607; 439/610

[58] Field of Search ..... 439/607, 608, 609, 610, 439/906, 904, 905

[56] References Cited

U.S. PATENT DOCUMENTS

| | | | |
|---|---|---|---|
| 4,585,292 | 4/1986 | Frantz et al. | 439/610 |
| 4,653,836 | 3/1987 | Peele | 439/610 |
| 4,687,263 | 8/1987 | Cosmos et al. | 439/607 |
| 4,789,357 | 12/1988 | Yamaguchi et al. | 439/607 |

FOREIGN PATENT DOCUMENTS

| | | | |
|---|---|---|---|
| 0090539 | 10/1983 | European Pat. Off. | 439/906 |

*Primary Examiner*—Larry I. Schwartz

*Assistant Examiner*—Hien D. Vu

*Attorney, Agent, or Firm*—Stephen Z. Weiss; Charles S. Cohen

[57] ABSTRACT

A shielded electrical connector includes an insulating housing having a front mating end and a rear conductor receiving end, with conductor receiving passages extending between the ends. A metal shell is disposed about the insulating housing between its ends. A metal shield is adapted to engage the shell and enclose at least the rear conductor receiving end of the housing. The shield may be made up of two halves which are interconnected by snap latch detents when moved together in a direction generally transverse of the connector. The shield is interconnected to the shell by snap latch devices when the shield and the shell are moved together in a direction generally axially of the connector. The snap latch devices are configured to prevent disconnection of the shield and the shell once the shield and shell are interconnected.

13 Claims, 3 Drawing Sheets

SHIELDED ELECTRICAL CONNECTOR

FIELD OF THE INVENTION

This invention generally relates to the art of electrical connectors and, particularly, to an electrical connector which has a multi-component shield assembly which is readily interconnected.

BACKGROUND OF THE INVENTION

There is an ever increasing demand for effective electrical shielding of electrical connectors in view of the continuing complexity and miniaturization of communication devices which are affected by electromagnetic interference.

Such shielded connectors must be capable of manufacture and assembly with economical methods which are capable of adaptation to standardized connector configurations and sizes. Most such connectors include shield means which are readily stamped and formed from metal material complementary in shape to the profile of the shielded connector components. An example of a standardized connector configuration is a D-Sub connector.

In addition, shields for connectors as described above most often must be fabricated of a plurality of components which must be readily interconnected either for economical mass production or easy assembly in the field. Complex assembly processes or manipulations are quite undesirable.

This invention is directed to solving the above problems of meeting standardization and assembly requirements by providing a shield means which is extremely simple to assemble and can be adapted for use with various connectors, including D-Sub connectors.

SUMMARY OF THE INVENTION

An object, therefore, of the invention is to provide a new and improved shielded electrical connector which is easy to manufacture and easy to assemble for economical and efficiency purposes both in mass production and field environments.

In the exemplary embodiment of the invention, a shielded electrical connector assembly includes an insulating housing having a front mating end and a rear conductor receiving end. The housing includes conductor receiving passages extending between its ends defining a front-to-rear axial direction. A metal shell means is disposed about the insulating housing between its ends. Either an assembled pair of metal shield halves or a single shield are adapted to engage the shell means and enclose at least the rear conductor receiving end of the insulating housing.

The invention contemplates a complementary coupling means between the metal shield halves adapted to interconnect the shield halves when moved together in a direction generally transverse to the axial direction of the housing. In an alternative embodiment the shield is in one piece. Complementary coupling means is provided between the metal shield and the metal shell means and adapted to interconnect the shell means and the shield when moved together in a direction generally parallel to the axial direction of the housing. Therefore, it can be seen that the multi-component shield assembly is completely assembled by interengaging means which interconnect the components by simple movement toward each other. The invention contemplates that the complementary coupling means be configured to prevent disconnection of the shell means and the shield once the shell means and shield are interconnected.

Specifically, as disclosed herein, the shell means and the metal shield are fabricated as stamped and formed components. The complementary coupling means between the metal shield halves and the complementary engaging means between the shield and the shell means are formed as snap latch means to further simplify the interconnection of the shield assembly by simple snapping actions.

Other objects, features, and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
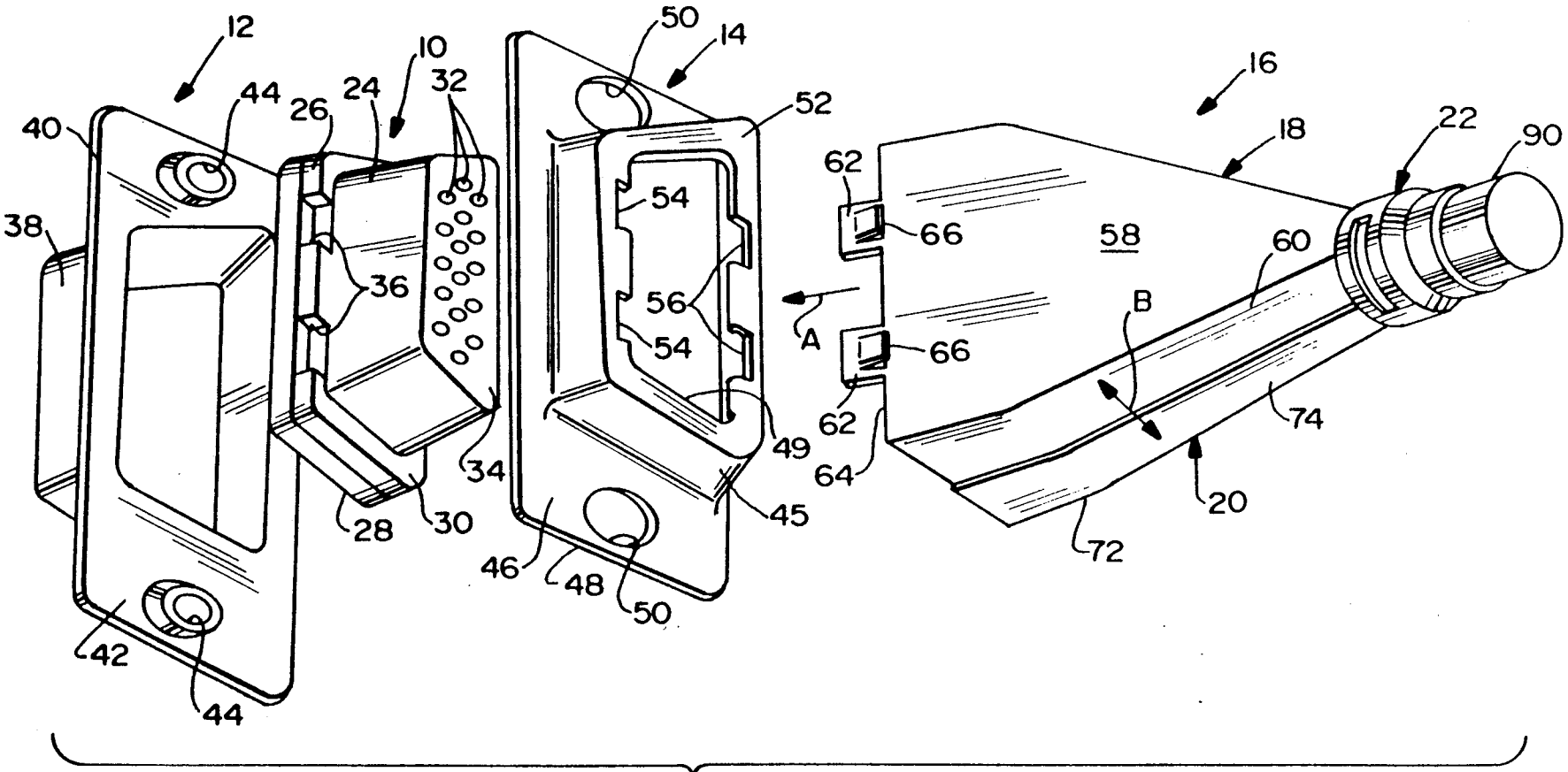
FIG. 1 is an exploded perspective view of the components of a shielded electrical connector assembly incorporating the concepts of the invention.
Figure 3:
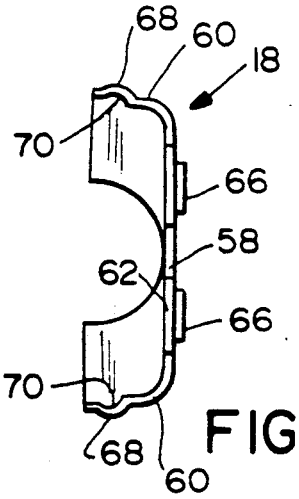
FIG. 3 is an end elevational view of the shield half of FIG. 2, looking toward the left-hand end thereof.
Figure 2:
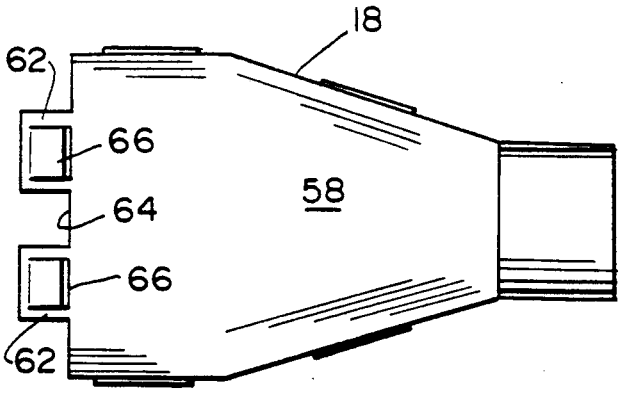
FIG. 2 is a top plan view of one of the metal shield halves.
Figure 7:
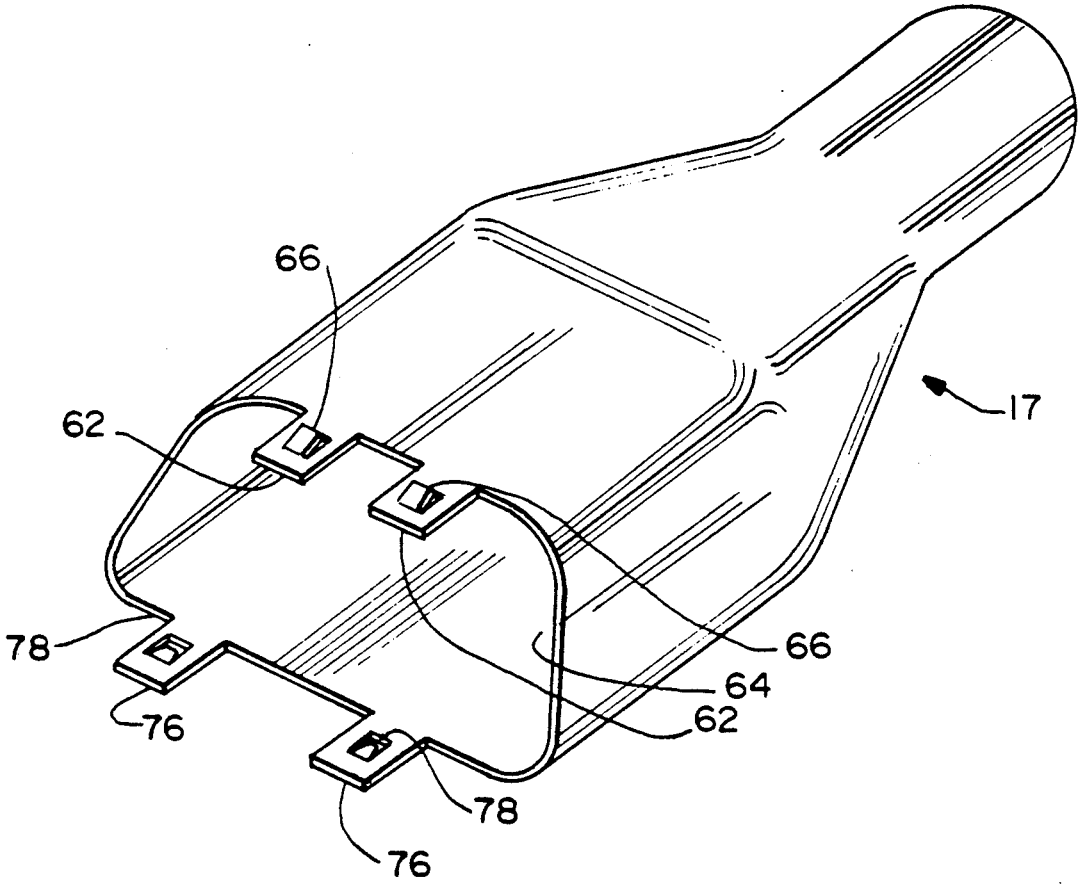
FIG. 7 is a perspective view of the one piece metal shield.

Referring to the drawings in greater detail, and first to FIG. 1, the invention contemplates a shielded electrical connector assembly which includes an insulating or dielectric housing, generally designated 10, a front mating end cover, generally designated 12, a rear metal shell, generally designated 14, and a rear metal shield assembly, generally designated 16. The shield assembly includes a pair of metal shield halves, generally designated 18 and 20. For purposes of facilitating the description herein, although the electrical connector is omnidirectional, shield half 18 will be referred to as the top shield half and shield half 20 will be referred to as the bottom shield half. Cover 12, shell 14 and shield halves 18 and 20 all are stamped and formed of metal material. In an alternate embodiment in FIG. 7 the shield generally designated 17 is formed in one piece.

Shield assemblies 16 and 17 are coupled, by any appropriate means, generally designated 22, such as crimp means, to a shielded electrical cable, such as to a shielding braid of the cable.

Insulating housing 10 includes a rearwardly projecting body portion 24 and a forward peripheral flange 26 which defines a front face 28 of the housing and a rear face 30 of the flange. As can be seen in FIG. 1, body 12 has a profile of a standardized D-Sub connector and includes a plurality of conductor or terminal receiving passages 32 extending between a front mating end defined by front face 28 of flange 26 and a rear conductor receiving end defined by a rear face 34 of body 24. For purposes of directional description herein and in the claims hereof, body 10 therefore defines a front-to-rear axial direction generally parallel to passages 32. Lastly, for purposes described hereinafter, flange 26 has a pair of recesses 36 on the top thereof as seen in the drawing, and a similarly located pair of recesses on the bottom thereof (not visible in the drawing).

Front mating end cover 12 includes a "D" shaped forwardly projecting flange 38 for receiving a complementary connector (not shown) and a peripheral flange 40 defining a rear face 42. Flange 40 has a pair of side chimneys 44.

Metal shell 14 includes a rearwardly projecting envelope portion 45 integral with a front flange 46 defining a forward face 48 and a rear aperture 49. Flange 46 has a pair of side apertures 50 which are alignable with chimneys 44 in flange 40 of front mating end cover 12. A peripheral flange 52 projects radially inwardly about the rear end of envelope portion 45 of metal shield 14 and includes two pairs 54 and 56, respectively, of notches or openings for purposes described hereinafter. The inside profile and dimensions of envelope portion 45 are such as to comfortably receive and fixably position flange 26 of insulating housing 10, with body portion 24 of the insulating housing projecting rearwardly through aperture 49 at the rear of the envelope portion.

Figure 6:
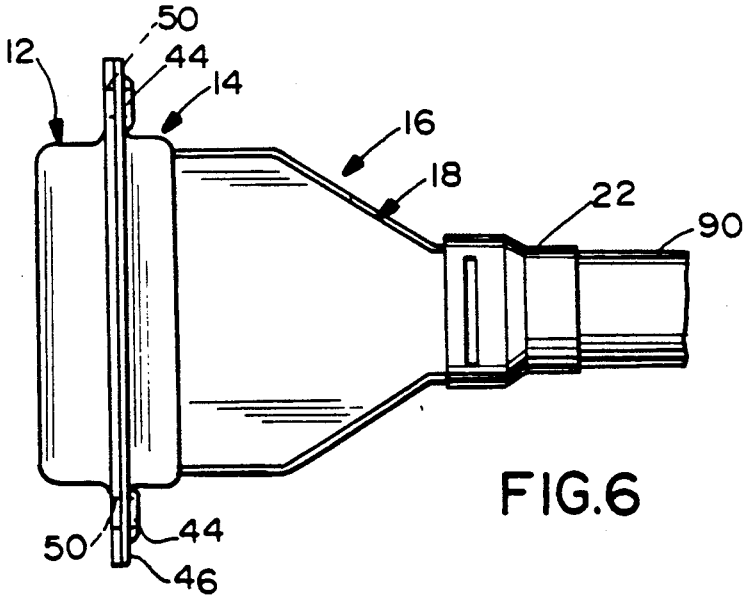
FIG. 6 is a plan view of the shield halves and shell in assembled condition.

Before proceeding with a description of shield assembly 16 and the one piece shield 17, it can be seen from FIG. 1 and the description above, that insulating housing 10 can be readily assembled to metal shell 14 by positioning flange 26 of the housing within envelope portion 45 of the shell. The shell then is brought into position against front mating end cover 12, with flanges 46 and 52, respectively, in abutment, and, as shown in FIG. 6, chimneys 44 on cover 12 are formed or rolled back over flange 46 about apertures 50 to secure insulating housing 10, front mating end cover 12 and metal shell 14 in assembled condition.

As stated above, metal shield assembly 16 includes a top metal shield half 18 and a bottom metal shield half 20. Referring to FIGS. 2–5 in conjunction with FIG. 1, shield half 18 (FIGS. 2 and 3) includes a top wall 58 and a pair of depending side walls 60, with the shield half tapering rearwardly toward cable securing means 22. In the shield assembly 16 and the one piece shield 17, a pair of tongues 62 project forwardly from a front edge 64. Tongues 62 only appear in the top wall 58 in the top metal shield half 18. Each tongue 62 has a stamped and formed, outwardly bent latch tab 66. As seen best in FIG. 3, side walls 60 include outwardly projecting, formed detents 68 which define interior detent recesses 70.

Figure 5:
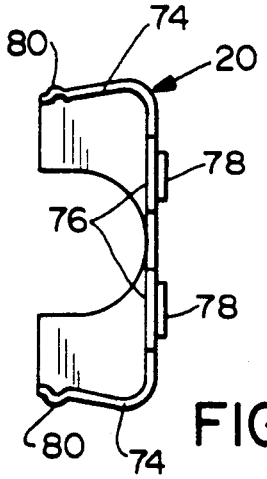
FIG. 5 is an end elevational view of the shield half of FIG. 4, looking toward the left-hand end thereof.
Figure 4:
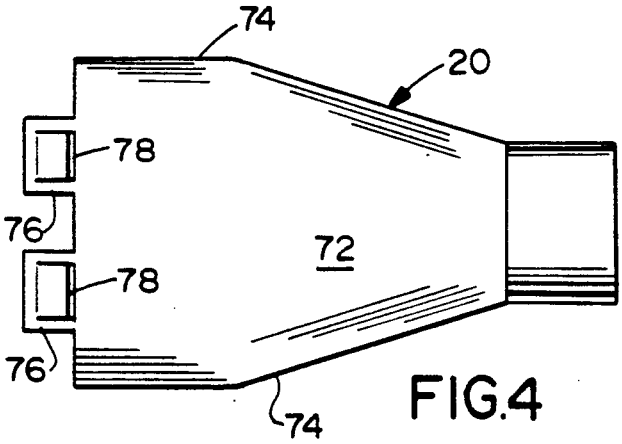
FIG. 4 is a bottom plan view of the other shield half which interconnects with the shield half of FIG. 2.

Referring to FIGS. 4 and 5 in conjunction with FIG. 1, bottom shield half 20 is constructed substantially identical to top shield half 18, in that the bottom shield half includes a bottom wall 72, a pair of side walls 74, a pair of forwardly projecting tongues 76, a pair of stamped and formed latch tabs 78 on tongues 76, and the bottom shield half tapers complementarily in shape with top shield half 18 toward cable securing means 22. The principal difference between bottom shield half 20 and top shield half 18 is that outwardly projecting detents 80 (FIG. 5) are formed smaller than detents 68 in side walls 60 of top shield half 18. In addition, side walls 74 of bottom shield half 20 are bent inwardly versus the outward flare of side walls 60 of top shield half 18 (see FIG. 3). With these differences, side walls 74 of bottom shield half 20 can telescope within side walls 60 of top shield half 18. Outwardly projecting detents 80 of the bottom shield half are effective to interconnect the shield halves by snapping into interior detent recesses 70 formed by detents 68 in side walls 60 of the top shield half.

The one piece shield 17 also has a pair of forwardly projecting tongues 76 and a pair of stamped and formed latch tabs 78 on tongues 76.

As stated above, shield halves 18 and 20 are interconnected by their telescoping side walls 60 and 74, respectively, and by snapping action of detents 80 in detent recesses 70. This is indicated by double-headed arrow "B" which can be seen to be in a direction generally transverse to the front-to-rear axial direction of the connector.

Shield assembly 16, formed by shield halves 18 and 20, and one piece shield 17 are interconnected with metal shell 14 by moving the shield assembly toward the shell in the direction of arrow "A" (FIG. 1). The shield assembly is interconnected to the shell by moving tongues 62 into openings 54 of the shell, and tongues 76 into openings 56 of the shell. Resilient latch tabs 66 and 78 snap behind flange 52 in the areas of openings 54 and 56, respectively, to interconnect the shield assembly with the shell by a snapping action in a direction axially of the connector. With latch tabs 66 and 78 being bent outwardly and rearwardly, the rear distal edges thereof lock behind flange 52 and prevent the shield assembly from disconnecting from the shell once interconnected therewith.

FIG. 6 shows front mating end cover 12, metal shell 14 and metal shield assembly 16 (comprising shield halves 18, 20) in completely assembled condition. It can be seen that insulating housing 10 (FIG. 1) is completely enclosed and shielded by the assembly. Lastly, although not shown in FIG. 6, the entire stamped and formed metal assembly which surrounds dielectric housing 24 can be overmolded with a plastic material which may form a strain relief about the forward end of an electrical cable 90 shown in FIG. 6.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A shielded electrical connector assembly, comprising:

an insulating housing having a front mating end and a rear conductor receiving end defining a front-to-rear axial direction therebetween, and conductor receiving passages extending between the ends;

metal shell means about the insulating housing between said ends;

a one piece metal shield adapted to engage the metal shell means and enclose at least the rear conductor receiving end of the insulating housing; and complementary coupling means between the metal shield and the metal shell means and adapted to interconnect the shell means and the shield when moved together in a direction generally parallel to said axial direction, the complementary coupling means being configured to prevent disconnection of the shell means and the interconnected sides once the shell means and shields are interconnected.

2. The shielded electrical connector of claim 1 wherein said complementary coupling means comprise snap latch means between the metal shell means and said metal shield for interconnecting the shell means and the shield by a snapping action.

3. The shielded electrical connector of claim 2 wherein said snap latch means comprise an opening in the metal shell means and a resilient latching tongue on the metal shield for snapping into the opening.

4. The shielded electrical connector of claim 3 wherein said opening surrounds the insulating housing.

5. The shielded electrical connector of claim 4 wherein said insulating housing includes a recess for accommodating the resilient latching tongue.

6. A shielded electrical connector assembly, comprising:

an insulating housing having a front mating end and a rear conductor receiving end defining a front-to-rear axial direction therebetween, and conductor receiving passages extending between the ends;

a stamped and formed metal shell means about the insulating housing between said ends;

a pair of stamped and formed half metal shields adapted, when assembled, to engage the shell means and enclose at least the rear conductor receiving end of the insulating housing;

first snap latch means between the half metal shields and adapted to interconnect the half shields by a snapping action when moved together in a direction generally transverse to said axial direction; and second snap latch means between at least one of the half metal shields and the metal shell means and adapted to interconnect by the shell means and the interconnected shields by a snapping action when moved together in a direction generally parallel to said axial direction, the second snap latch means being configured to prevent disconnection of the shell means and the interconnected shields once the shell means and shields are interconnected.

7. The shielded electrical connector of claim 6 wherein said half metal shields include telescoping wall means with said first snap latch means therebetween.

8. The shielded electrical connector of claim 6 wherein said second snap latch means are provided between both half metal shields and the metal shell means.

9. The shielded electrical connector of claim 6 wherein said first snap latch means comprise projecting detent means on one of the shields engageable into detent recess means on the other of the shields.

10. The shielded electrical connector of claim 9 wherein said half shields include telescoping wall means with said projecting detent means and detent recess means thereon.

11. The shielded electrical connector of claim 6 wherein said second snap latch means comprise an opening in the half metal shell means and a resilient latching tongue on the at least one half metal shield for snapping into the opening.

12. The shielded electrical connector of claim 11 wherein said opening surrounds the insulating housing.

13. The shielded electrical connector of claim 12 wherein said insulating housing includes a recess for accommodating the resilient latching tongue.

* * * * *